United States Patent [19]

Kubo et al.

[11] Patent Number: 4,513,052

[45] Date of Patent: Apr. 23, 1985

[54] HEAT-SENSITIVE RECORDING MATERIAL

[75] Inventors: Keishi Kubo, Yokohama; Eiichi Kawamura, Numazu, both of Japan

[73] Assignee: Ricoh Co., Ltd., Tokyo, Japan

[21] Appl. No.: 552,847

[22] Filed: Nov. 16, 1983

Related U.S. Application Data

[63] Continuation of Ser. No. 337,338, Jan. 6, 1982, abandoned.

[30] Foreign Application Priority Data

Jan. 16, 1981 [JP] Japan ..... 56-5292

[51] Int. Cl.[3] ..... B05D 3/06

[52] U.S. Cl. ..... 428/219; 428/341; 428/913; 428/914; 106/21; 430/338; 430/340; 346/217

[58] Field of Search ..... 428/913, 914, 411, 219, 428/341; 106/21; 282/27.5; 430/338, 340

[56] References Cited

U.S. PATENT DOCUMENTS 4,091,122 5/1978 Davis et al. ..... 282/27.5

4,333,984 6/1982 Igarashi et al. ..... 106/21

FOREIGN PATENT DOCUMENTS 52-33740 3/1977 Japan ..... 282/27.5

*Primary Examiner*—Won H. Louie

*Attorney, Agent, or Firm*—Flynn, Thiel, Boutell & Tanis

[57] ABSTRACT

A heat-sensitive recording material comprising a support and a heat-sensitive color forming layer formed on said support that comprises a colorless or pale-color leuco dye and an acidic material capable of making said leuco dye develop color when heated, wherein said heat-sensitive color forming layer further comprises at least one of the compounds which are expressed by the following general formulas (I), (II) or (III):

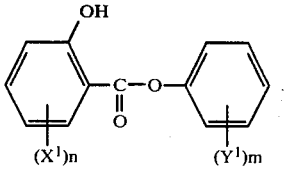

(I)

(wherein $X^1$ represents a hydrogen atom or a halogen atom; $Y^1$ represents an alkyl group, an alkoxy group, a halogen atom, a benzyl group, a hydroxyl group, a carboxyl group or an allyl group; m and n are each an integer ranging from 1 to 3, respectively; and $X^1$ and $Y^1$ may be either identical or different from each other when m or n is an integer of 2 or more)

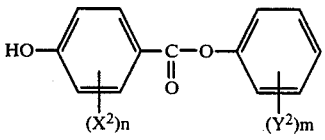

(II)

(wherein $X^2$ represents a hydrogen atom or a halogen atom; $Y^2$ represents a hydrogen atom, an alkyl group, an alkoxy group, a halogen atom, a benzyl group, a hydroxyl group, a carboxyl group or an allyl group; m and n are each an integer ranging from 1 to 3, respectively; and $X^2$ and $Y^2$ may be either identical or different from each other when m or n is an integer of 2 or more)

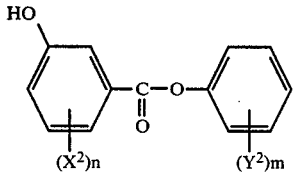

(III)

[wherein $X^2$, $Y^2$, n and m are respectively the same as in the foregoing general formula (II).]

8 Claims, No Drawings

HEAT-SENSITIVE RECORDING MATERIAL

This application is a continuation of U.S. Ser. No. 337,338, filed Jan. 6, 1982, abandoned.

BACKGROUND OF THE INVENTION (1) Field of the Invention

The present invention relates to an improved heat-sensitive recording material employing a colorless or pale-color leuco dye and an acidic material such as a phenolic compound or an organic acid capable of making said leuco dye develop color when heated, which is intended to obtain a colored image of high density developed by recording with a low heat energy at a low temperature and to effect smooth recording free from generation of residue of any adhesive substance and sticking thereof onto the thermal head by virtue of making the heat-sensitive color forming layer contain at least one of the compounds expressed by the following general formulas (I), (II) and (III):

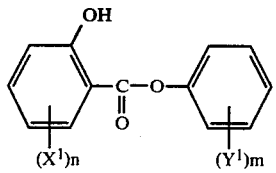

(I)

(wherein $X^1$ represents a hydrogen atom or a halogen atom; $Y^1$ represents an alkyl group, an alkoxy group, a halogen atom, a benzyl group, a hydroxyl group, a carboxyl group or an allyl group; m and n are each an integer ranging from 1 to 3, respectively; and $X^1$ and $Y^1$ may be either identical or different from each other when m or n is an integer of 2 or more;)

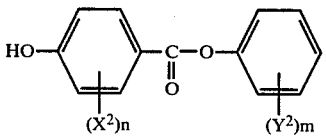

(II)

(wherein $X^2$ represents a hydrogen atom or a halogen atom; $Y^2$ represents a hydrogen atom, an alkyl group, an alkoxyl group, a halogen atom, a benzyl group, a hydroxyl group, a carboxyl group or an allyl group; m and n are each an integer ranging from 1 to 3, respectively; and $X^2$ and $Y^2$ may be either identical or different from each other when m or n is an intger of 2 or more;)

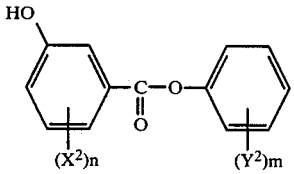

(III)

[wherein $X^2$, $Y^2$, n and m are respectively the same as in the foregoing general formula (II).]

2. Description of the Prior Art

Heat-sensitive recording material consists essentially of a support such as paper and a heat-sensitive color forming layer capable of developing color when heated, which layer is formed on the surface of said support. For the purpose of heating on this occasion a thermal printer having a thermal head therein or the like is usually employed, and image recording is effected according to heat signals.

The heat-sensitive recording method employing such a recording material as described above is prevalent not only in copying books, documents and so forth, but in recording for various output units, e.g., electronic computers, facsimiles, meters, etc., and as to the recording material for use in this method, it is well known in this field of industry that recording materials prepared by forming a heat-sensitive color forming layer containing a colorless or pale-color leuco dye having a lactone, lactam or spiropyran ring and an acidic material, e.g., organic acid or a phenolic compound on a support display a distinct color tone and superior contrast. However, these heat-sensitive recording materials are recently desired to be so improved as to be fit for high-speed operation of the output units and prolonged printing.

Heretofore, in order to improve the heat-sensitivity of recording materials there have been adopted methods wherein acetoacetic anilide is employed (cf. Japanese Laid-open Patent Application No. 106746/1977), a method wherein particles of at least one of the dye and color developing agent are to be impregnated with a heat-meltable substance having a melting point ranging from 60° to 200° C. (cf. Japanes Laid-open Patent Application No. 48751/1978), a method wherein alkyl biphenyl and substituted biphenyl alkane having a melting point ranging from 60° to 200° C. are employed (cf. Japanese Laid-open Patent Application No. 39139/1978), method wherein saturated fatty acid having 12 to 22 carbon atoms is to be added to fatty acid amide (cf. Japanese Laid-open Patent Application No. 139740/1979), etc., but any of these methods leaves something to be desired in respect of the effect and a further improvement is desired. Moreover, the foregoing thermosensitizers are defective in that use of them in large quantities would cause adhesion of residue or 'sticking' onto the thermal head, resulting in remarkable deterioration of the traveling property. Therefore, in the case where it is required to obtain a distinct image of high density invariably even when used for a long term by applying especially a low heat energy at a low temperature, such as in high-speed facsimile transmission, it is necessary to reduce the color-developing temperature and also select a sensitizer having thermo-sensitivity which does not generate residue of adhesive substance or the like that is apt to stick onto the thermal head.

SUMMARY OF THE INVENTION

The present invention is intended to improve the heat sensitivity for color developing in order to obtain a color image of high density developed by the use a low heat energy at a low temperature with a view to providing high-speed recording materials, and is also intended to provide a recording material which can prevent adhesion of residue of adhesive substances onto the thermal head which is thereby free from sticking thereof, fit for use in printing for a long period and has a remarkably improved travelling property. The inventors of the present invention have found that the afore described defects in the prior art can be considerably made up for by making the recording material contain the compounds expressed by the foregoing general formulas.

The heat-sensitive recording material according to the present invention is a heat-sensitive recording material comprising a support and a heat-sensitive color forming layer as formed on said support that comprises a colorless or pale-color leuco dye and an acidic material capable of making said leuco dye develop color when heated, wherein said heat-sensitive color forming layer further comprises at least one of the compounds which are expressed by the following general formulas (I), (II) or (III):

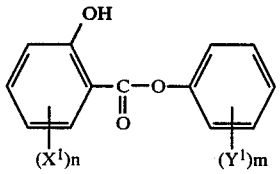

(I)

(wherein $X^1$ represents a hydrogen atom or a halogen atom; $Y^1$ represents an alkyl group, an alkoxy group, a halogen atom, a benzyl group, a hydroxyl group, a carboxyl group or an allyl group; m and n each are an integer ranging from 1 to 3, respectively; and $X^1$ and $Y^1$ may be either identical or different from each other when m or n is an integer of 2 or more;)

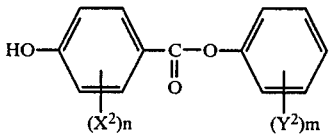

(II)

(wherein $X^2$ represents a hydrogen atom or a halogen atom; $Y^2$ represents a hydrogen atom, an alkyl group, an alkoxy group, a halogen atom, a benzyl group, a hydroxyl group, a carboxyl group or an allyl group; m and n are each respectively an integer ranging from 1 to 3; and $X^2$ and $Y^2$ may be either indentical or different from each other when m or n is an integer of 2 or more;)

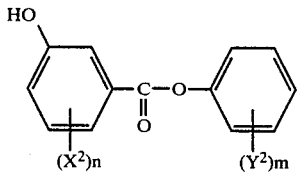

(III)

[wherein $X^2$, $Y^2$, n and m are respectively the same as in the foregoing formula (II).]

Although the reason why the abovementioned effect can be obtained in the present invention is not yet clear, it is conceivable that the compounds expressed by the foregoing general formulas (I), (II) and (III) act to lower the melting point of the essential ingredients of the material owing to the eutectic effect and to accelerate the melting speed thereof owing to the high mutual dissolving property between the compounds expressed by the general formulas (I), (II) and (III) and the ingredients, resulting in a remarkable enhancement of the color-developing speed, whereby there can be obtained a image of high density even by the use of a low heat energy. The fact that an image of high density is obtainable by the use of a low heat energy means that the $\gamma$ value of the color developing property is high, and the influence of the heat diffusion on applying a heat signal is minimized, a distinct recovered image being obtained through output units with a low heat energy like facsimile units.

Hereunder will be given principal examples of the compounds expressed by the general formulas (I), (II) and (III) and suitable for use in the present invention:

(1) phenyl 4-hydroxybenzoate
(2) 2-methoxyphenyl 4-hydroxybenzoate
(3) 2-methoxy-4-methylphenyl 4-hydroxybenzoate
(4) 3,5-dihydroxyphenyl 4-hydroxybenzoate
(5) 4-carboxyphenyl 3-hydroxybenzoate
(6) 4-butoxyphenyl 4-hydroxybenzoate
(7) 4-chlorophenyl 4-hydroxybenzoate
(8) 2-chlorophenyl salicylate
(9) 4-chlorophenyl salicylate
(10) 2,4-dichlorophenyl salicylate
(11) 2,6-dichlorophenyl salicylate
(12) 2,4,6-trichlorophenyl salicylate
(13) 2-bromophenyl salicylate
(14) 4-bromophenyl salicylate
(15) 2,4-dibromophenyl salicylate
(16) 2,6-dibromophenyl salicylate
(17) 2,4,6-tribromophenyl salicylate
(18) 3-methylphenyl salicylate
(19) 2,4-dimethylphenyl salicylate
(20) 4-tertiary-butylphenyl salicylate
(21) 4-tertiary-amylphenyl salicylate
(22) 2-methoxyphenyl salicylate
(23) 2-ethoxyphenyl salicylate
(24) 3-methoxyphenyl salicylate
(25) 4-hydroxyphenyl salicylate
(26) 4-benzylphenyl salicylate
(27) 2-methoxy-4-allylphenyl salicylate
(28) 4-chloro-3-methylphenyl salicylate
(29) 3-hydroxyphenyl salicylate
(30) 4-allylphenyl salicylate
(31) 3-methylphenyl 5-chlorosalicylate
(32) 2-methoxyphenyl 3,5-dichlorosalicylate In this context, it is desirable that the quantity of a compound expressed by any of the foregoing general formulas to be added to the heat-sensitive color forming layer is in the range of from 0.1 to 5.0 parts by weight per 1 part by weight of the leuco dye. When the quantity is less than 0.1 part by weight the effect of improving the heat-sensitivity of the recording material is slight, while in the case where it is more than 5 parts by weight any furtherance of the effect of improving the heat-sensitivity to be obtained by adding the above defined quantity can not be expected.

In the present invention, conventional leuco dyes, acidic materials such as organic acids, phenolic compound, etc. and binders are used. Hereunder will be given concrete examples of principal materials useful in the present invention.

1. Leuco dye:

Typical leuco dyes suitably used herein may be enumerated as follows:

(A) Triphenylmethane dyes having the following general formula:

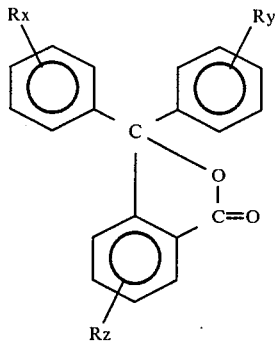

(wherein Rx, Ry and Rz are each a hydrogen atom, a hydroxyl group, a halogen, an alkyl group, a nitro group, an amino group, a dialkylamino group, a monoalkylamino group or an aryl group.)

Some of said dyes may be enumerated as follows:

3,3-bis(p-dimethylaminophenyl)phthalide, 3,3-bis(p-dimethylaminophenyl)-6-dimethylaminophthalide (another name: Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)phthalide, (B) Fluoran dyes having the following general formula:

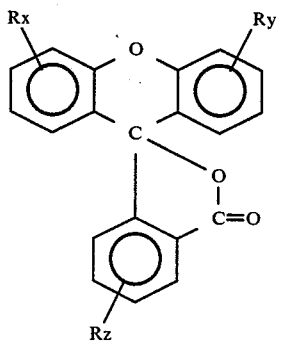

(wherein Rx, Ry and Rz are the same as defined in (1-A)

Some of said dyes may be enumerated as follows:

3-dimethylamino-5,7-dimethylfluoran, 3-diethylamino-7-methylfluoran, 3-diethylamino-7,8-dibenzofluoran, 3-diethylamino-6-methyl-7-chlorofluoran (C) Fluoran dyes:

Some of said dyes may be enumerated as follows:

3-cyclohexylamino-6-chlorofluoran, 3-(N,N-diethylamino)-5-methyl-7-(N,N-dibenzylamino)fluoran, 3-pyrrolidino-6-methyl-7-anilinofluoran, 2-{N-(3'-trifluoromethylphenyl)amino}-6-diethylaminofluoran, and 2-{3,6-bis(diethylamino)-9-(o-chloroanilino)}xanthyl benzoic acid lactam (D) Lactone compounds having the following general formula:

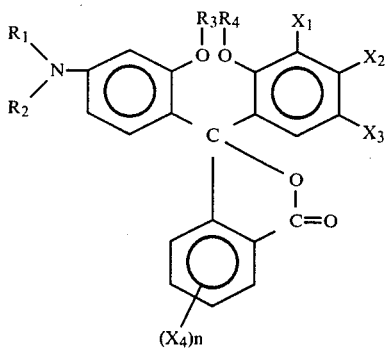

(wherein $R_1$ and $R_2$ are each a hydrogen atom, a lower alkyl group, a substituted or non-substituted aralkyl group, a substituted or non-substituted phenyl group, a cyanoethyl group or a $\beta$-halogenated ethyl group, or $R_1$ and $R_2$, when combined, are $-(CH_2)_4-$, $-(CH_2)_5$ or $-(CH_2)_2O-(CH_2)_2$, $R_3$ and $R_4$ are each hydrogen, a lower alkyl group, an alkyl group, an amyl group or a phenyl group, any one of $R_3$ and $R_4$ being hydrogen, $X_1$, $X_2$ and $X_3$ are each hydrogen, a lower alkyl group, a lower alkoxy group, a halogen atom, a halogenated methyl group, an amino group or substituted amino group, $X_4$ is a hydrogen atom, a halogen atom, a lower alkyl group or a lower alkoxy group, and n is an integer of 0 or 1 to 4.)

Some of said compounds may be enumerated as follows:

3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, and 3-(2'-methoxy-4'-dimethylaminophenyl)-3-(2'-hydroxy-4-chloro-5'-methylphenyl)phthalide.

2. Organic acid:

This includes oxalic acid, maleic acid, tartaric acid, citric acid, succinic acid, benzoic acid, stearic acid, gallic acid, salicylic acid, 1-hydroxy-2-naphthoic acid, o-hydroxybenzoic acid, m-hydroxybenzoic acid and 2-hydroxy-p-toluic acid.

3. Phenolic compound:

This includes 4,4'-isopropylidenediphenol (bisphenol A), 3,5-xylenol, thymol, p-tert-butylphenol, 4-hydroxyphenoxide, methyl-4-hydroxybenzoate, 4-hydroxyacetophenone, $\alpha$-naphthol, $\beta$-naphthol, catechol, resorcin, hydroquinone, 4-tert-octylcatechol, 4,4'-sec-butylidenephenol, 2,2'-dihydroxydiphenol, 2,2-methylenebis(4-methyl-6-tert-butylphenol), 2,2-bis(4-hydroxyphenyl)propane, 4,4'-isopropylidene-bis(2-tert-butylphenol), 4,4'-sec-butylidenediphenol, pyrogallol, phloroglucinol and phloroglucine carboxylic acid.

4. Binder:

This includes water-soluble substances such as polyvinyl alcohol, methoxycellulose, hydroxyethyl cellulose, carboxymethyl cellulose, polyvinyl pyrrolidone, polyacryl amide, polyacrylic acid, starch, gelatin, etc. as well as aqueous emulsions of substances such as polystyrene, vinyl chloride-vinyl acetate copolymer, polybutyl methacrylate, etc.

The heat-sensitive recording materials according to the present invention render it possible to enhance the definition of a color image developed on recording by means of adding fine particles of calcium carbonate, silica, alumina, magnesium oxide, talc, barium sulfate, aluminum stearate or the like and also further improve the travelling property of the thermal head by means of adding lubricant such as linseed oil, tung oil, wax, paraffin, polyethylene wax, chlorinated paraffin, etc. to the heat-sensitive color forming layer thereof.

In order to prepare a heat-sensitive recording material according to the present invention, it will do to coat a dispersion obtained by dispersing the ingredients of the heat-sensitive color forming layer on a support such as paper, synthetic paper, plastic sheet or film, etc. and drying the ingredients thereafter to thereby form a heat-sensitive color forming layer.

The thickness of the heat sensitive color forming layer is about 5 to 10 g/m$^2$ in terms of quantity of solids adhered thereto.

Further, the appropriate quantity of the leuco dye to be contained in the heat-sensitive color forming layer is in the range of from 10 to 20% by weight, and the appropriate quantity of the acidic material to be contained in the same is in the range of from 40 to 60% by weight.

DESCRIPTION OF THE PREFERRED EMBODIMENTS

EXAMPLE 1

Dispersions A and B were respectively prepared by mixing the following ingredients by means of a ball-mill for 10 hours and thereafter the thus obtained dispersions A and B were mixed, whereby a liquid for forming a heat-sensitive color forming layer was prepared.

| | | |
|---|---|---|
| Ingredients of dispersion A: | | |
| Crystal Violet lactone | 5.7 | parts by weight |
| polyvinyl alcohol (10% aqueous solution) | 23.0 | " |
| water | 21.3 | " |
| Ingredients of dispersion B: | | |
| bisphenol A | 21.0 | parts by weight |
| polyvinyl alcohol (20% aqueous solution) | 13.0 | " |
| 4-benzylphenyl salicylate | 11.0 | " |
| water | 5.0 | " |

The resulting solution was coated on a high quality paper weighing 50 g/m$^2$ by the use of a wire bar to form a heat-sensitive color forming layer with the solids in said solution adhering thereto to the extent of 5.79 g/m$^2$, whereby there was obtained a heat-sensitive recording material according to the present invention.

When printing was conducted at a temperature of 90° C. by employing the thus obtained recording material by means of a thermal printer equipped with a thermal head therein, there was obtained a distinct blue image.

Further, a comparative heat-sensitive recording material (1) was prepared through the same procedure as above except omitting 4-benzylphenyl salicylate, and another comparative heat-sensitive recording material (2) was prepared also through the same procedure as above except for replacing 4-benzylphenyl salicylate with the same quantity of amide stearate, which is the most popular thermo-sensitizer. The color developing effect of the recording material of the present invention was compared with that of these comparative recording materials at the same temperature of printing. The result was as shown in the following table.

| | | Recording material of the present invention | Comparative recording material (1) | Comparative recording material (2) |
|---|---|---|---|---|
| Density of color image developed on recording | 75° C. | 0.62 | 0.53 | 0.59 |
| | 80° C. | 0.79 | 0.62 | 0.69 |
| | 85° C. | 0.90 | 0.70 | 0.79 |
| | 90° C. | 0.95 | 0.78 | 0.85 |
| | 95° C. | 0.98 | 0.82 | 0.90 |
| | 100° C. | 1.00 | 0.86 | 0.95 |
| | 110° C. | 1.03 | 0.90 | 0.96 |
| | 120° C. | 1.04 | 0.91 | 0.97 |
| Adhesion of residue onto thermal head (as measured after continuous operation on 500 m recording material by means of facsimile) | | nil | nil | was observed |

Remark:
The image density was measured by means of Macbeth densitometer.

As evident from the foregoing, the recording material according to the present invention could produce a satisfactorily high-density color image developed on recording even with a low heat energy at a low temperature, the thermal head was free from generation of residue (adhesive matter) and sticking thereof, and the travelling property of the thermal head was excellent, thereby verifying the superiority of the present invention, while the comparative recording materials were not only low in density of the color image developed on recording at a low temperature, but the travelling property of the thermal head was inferior.

EXAMPLES 2-4

3 varieties of heat-sensitive recording materials were prepared by employing—

(2) 2-methoxyphenyl 4-hydroxybenzoate, (3) 4-carboxyphenyl 3-hydroxybenzoate, and (4) 4-hydroxyphenyl salicylate, in place of 4-benzylphenyl salicylate used in Example 1, respectively. When printing was conducted in the same way as Example 1 by means of the respective heat-sensitive recording materials thus prepared, there was rapidly obtained a distinct blue-color image, and the aforedescribed recording properties of these recording materials also proved as superior as in Example 1.

What is claimed is:

1. A heat-sensitive recording material comprising a support and a heat-sensitive, color-forming layer formed on said support, said color-forming layer comprising (1) 10 to 20 weight % of a colorless or pale leuco dye selected from the group consisting of (A) triphenylmethane dyes of the formula:

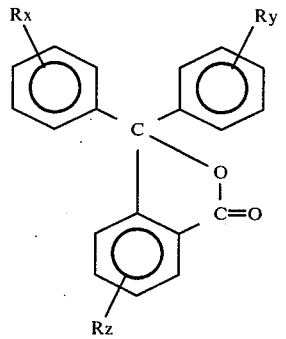

wherein Rx, Ry and Rz are each hydrogen, hydroxyl, halogen, alkyl, nitro, amino, dialkylamino, monoalkylamino or aryl;

(B) fluoran dyes of the formula:

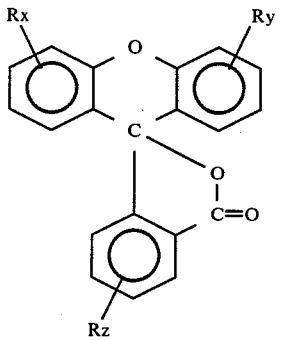

wherein Rx, Ry and Rz have the same meanings as defined above;

(C) fluoran dyes selected from the group consisting of 3-cyclohexylamino-6-chlorofluoran,
3-(N,N-diethylamino)-5-methyl-7-(N,N-dibenzylamino)fluoran,
3-pyrrolidino-6-methyl-7-anilinofluoran,
2-{N-(3'-trifluoromethylphenyl)amino}-6-diethylaminofluoran, and
2-{3,6-bis(diethylamino)-9-(o-chloroanilino)}xanthyl benzoic acid lactam;

(D) lactone compounds of the formula:

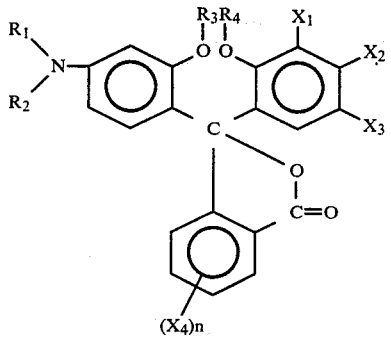

wherein $R_1$ and $R_2$ are each hydrogen, lower alkyl, substituted or non-substituted aralkyl, substituted or non-substituted phenyl, cyanoethyl or $\beta$-halogenated ethyl, or $R_1$ and $R_2$, bonded together, are $-(CH_2)_4-$, $-(CH_2)_5$ or $-(CH_2)_2O-(CH_2)_2$, $R_3$ and $R_4$ are each hydrogen, alkyl or phenyl, one of $R_3$ and $R_4$ being hydrogen, $X_1$, $X_2$ and $X_3$ are each hydrogen, lower alkyl, lower alkoxy, halogen, halogenated methyl, amino or substituted amino, $X_4$ is hydrogen, halogen, lower alkyl or lower alkoxy, and n is an integer of from 0 to 4, (2) 40 to 60 weight % of an acidic material capable of developing color in said leuco dye when said color-forming layer is heated to a developing temperature, wherein said acidic material is selected from the group consisting of phenolic compounds different from the compounds of the formulas (I), (II) and (III) set forth below, and (3) 0.1 to 5.0 parts by weight, per 1 part by weight of said leuco dye, of at least one development-enhancing compound of the formula (I), (II) or (III):

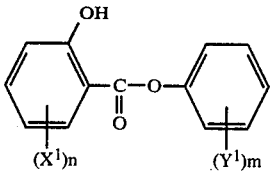

(I)

wherein $X^1$ is hydrogen or halogen; $Y^1$ is alkyl, alkoxy, halogen, benzyl, hydroxyl, carboxyl or allyl; m and n are integers in the range of from 1 to 3; and $X^1$ and $Y^1$ can be either identical or different from each other when m or n is an integer of 2 or more;

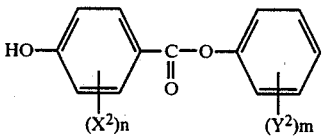

(II)

wherein $X^2$ is hydrogen or halogen; $Y^2$ is hydrogen, alkyl, alkoxy, halogen, benzyl, hydroxyl, carboxyl or allyl; m and n are integers in the range of from 1 to 3; and $X^2$ and $Y^2$ can be either identical or different from each other when m or n is an integer of 2 or more; and

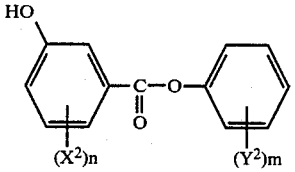

(III)

wherein $X^2$, $Y^2$, n and m have the same meanings as defined above.

2. A heat-sensitive recording material according to claim 1, wherein said development-enhancing compound is selected from the group consisting of phenyl 4-hydroxybenzoate, 2-methoxyphenyl 4-hydroxybenzoate, 2-methoxy-4-methylphenyl 4-hydroxybenzoate, 3,5-dihydroxyphenyl 4-hydroxybenzoate, 4-carboxyphenyl 3-hydroxybenzoate, 4-butoxyphenyl 4-hydroxybenzoate, 4-chlorophenyl 4-hydroxybenzoate, 2-chlorophenyl salicylate, 4-chlorophenylsalicylate, 2,4-dichlorophenyl salicylate, 2,6-dichlorophenyl salicylate, 2,4,6-trichlorophenyl salicylate, 2-bromophenyl salicylate, 4-bromophenyl salicylate, 2,4-dibromophenyl salicylate, 2,6-dibromophenyl salicylate, 2,4,6-tribromophenyl salicylate, 3-methylphenyl salicylate, 2,4-dimethylphenyl salicylate, 4-tertiary-butylphenyl salicylate, 4-tertiary-amylphenyl salicylate, 2-methoxyphenyl salicylate, 2-ethoxyphenyl salicylate, 3-methoxyphenyl salicylate, 4-hydroxyphenyl salicylate, 4-benzylphenyl salicylate, 2-methoxy-4-allylphenyl salicylate, 4-chloro-3-methylphenyl salicylate, 3-hydroxyphenyl salicylate, 4-allylphenyl salicylate, 3-methylphenyl 5-chlorosalicylate and 2-methoxyphenyl 3,5-dichlorosalicylate.

3. A heat-sensitive recording material according to claim 2, wherein said development-enhancing compound is 4-benzylphenyl salicylate, 2-methoxyphenyl 4-hydroxybenzoate, 4-carboxyphenyl 3-hydroxybenzoate or 4-hydroxyphenyl salicylate.

4. A heat-sensitive recording material according to claim 1, wherein said acidic material (2) is at least one compound selected from the group consisting of 3,5-xylenol, thymol, p-tert-butylphenol, 4-hydroxyphenoxide, methyl-4-hydroxybenzoate, 4-hydroxyacetophenone, $\alpha$-naphthol, $\beta$-naphthol, catechol, resorcin, hydroquinone, 4-tert-octylcatechol, 4,4'-sec-butylidenephenol, 2,2'-dihydroxydiphenol, 2,2-methylene-bis(4-methyl-6-tert-butylphenol), 2,2-bis(4-hydroxyphenyl)-propane, 4,4'-isopropylidene-bis(2-tert-butylphenol), 4,4'-sec-butylidenediphenol, pyrogallol, and phloroglucinol.

5. A heat-sensitive recording material according to claim 1, wherein said color-forming layer is deposited on said support in an amount of from 5 to 10 g/m$^2$, calculated as the solids.

6. A heat-sensitive recording material according to claim 1, wherein said heat-sensitive layer further contains an amount of particles of a filler selected from the group consisting of calcium carbonate, silica, alumina, magnesium oxide, talc, barium sulfate, and aluminum stearate, effective to enhance the definition of a color image developed on said heat-sensitive layer, and an amount of a lubricant selected from the group consisting of linseed oil, tung oil, wax, paraffin, polyethylene wax, and chlorinated paraffin effective to improve the travelling property of a thermal head across the recording material.

7. A heat-sensitive recording material according to claim 1, wherein said acidic material consists of 2,2-bis(4-hydroxyphenyl)propane.

8. A heat-sensitive recording material according to claim 7 in which said development-enhancing compound is selected from the group consisting of phenyl 4-hydroxybenzoate, 2-methoxyphenyl 4-hydroxybenzoate, 2-methoxy-4-methylphenyl 4-hydroxybenzoate, 3,5-dihydroxyphenyl 4-hydroxybenzoate, 4-carboxyphenyl 3-hydroxybenzoate, 4-butoxyphenyl 4-hydroxybenzoate, 4-chlorophenyl 4-hydroxybenzoate, 2-chlorophenyl salicylate, 4-chlorophenylsalicylate, 2,4-dichlorophenyl salicylate, 2,6-dichlorophenyl salicylate, 2,4,6-trichlorophenyl salicylate, 2-bromophenyl salicylate, 4-bromophenyl salicylate, 2,4-dibromophenyl salicylate, 2,6-dibromophenyl salicylate, 2,4,6-tribromophenyl salicylate, 3-methylphenyl salicylate, 2,4-dimethylphenyl salicylate, 4-tertiary-butylphenyl salicylate, 4-tertiary-amylphenyl salicylate, 2-methoxyphenyl salicylate, 2-ethoxyphenyl salicylate, 3-methoxyphenyl salicylate, 4-hydroxyphenyl salicylate, 4-benzylphenyl salicylate, 2-methoxy-4-allylphenyl salicylate, 4-chloro-3-methylphenyl salicylate, 3-hydroxyphenyl salicylate, 4-allylphenyl salicylate, 3-methylphenyl 5-chlorosalicylate and 2-methoxyphenyl 3,5-dichlorosalicylate.

* * * * *